US006797032B2

(12) United States Patent
Swift

(10) Patent No.: US 6,797,032 B2
(45) Date of Patent: Sep. 28, 2004

(54) METHOD FOR MEASURING BATH LEVEL IN A BASIC OXYGEN FURNACE TO DETERMINE LANCE HEIGHT ADJUSTMENT

(75) Inventor: Thomas P. Swift, Baltimore, MD (US)

(73) Assignee: ISG Technologies Inc.

( * ) Notice: Subject to any disclaimer, the term of this patent is extended or adjusted under 35 U.S.C. 154(b) by 37 days.

(21) Appl. No.: 10/218,741

(22) Filed: Aug. 14, 2002

(65) Prior Publication Data

US 2003/0102609 A1 Jun. 5, 2003

Related U.S. Application Data

(62) Division of application No. 09/656,317, filed on Sep. 6, 2000, now Pat. No. 6,440,355.

(51) Int. Cl.[7] ..... C21C 1/04

(52) U.S. Cl. ..... 75/375; 266/44; 266/92; 266/99

(58) Field of Search ..... 266/78, 99, 225, 266/44, 92; 75/375

(56) References Cited

U.S. PATENT DOCUMENTS

| | | | | |
|---|---|---|---|---|
| 3,395,908 | A | 8/1968 | Woodcock | |
| 3,610,601 | A | 10/1971 | Bishop | |
| 3,663,204 | A | 5/1972 | Jungwirth | |
| 3,701,518 | A | 10/1972 | Herff | |
| 3,708,159 | A | 1/1973 | DeBray | |
| 3,727,897 | A | 4/1973 | Bennett | |
| 4,365,788 | A | 12/1982 | Block | |
| 4,413,810 | A | 11/1983 | Tenberg et al. | |
| 4,474,361 | A | 10/1984 | Kanemoto et al. | 266/80 |
| 4,880,212 | A | 11/1989 | Hagglund et al. | |
| 4,899,994 | A | 2/1990 | Zhidkov et al. | |
| 5,190,717 | A | 3/1993 | Bayless | |
| 5,827,474 | A | 10/1998 | Usher et al. | |
| 6,228,142 | B1 | 5/2001 | Shin et al. | |
| 6,440,355 | B1 | 8/2002 | Swift | 266/92 |

*Primary Examiner*—Scott Kastler
(74) *Attorney, Agent, or Firm*—Harold I. Masteller, Jr.

(57) ABSTRACT

The present invention is directed a method for adjusting the height of a lance with respect to a bath surface of any selected heat manufactured in a metallurgical vessel during a continuing series of heats.

19 Claims, 5 Drawing Sheets

Fig. 8
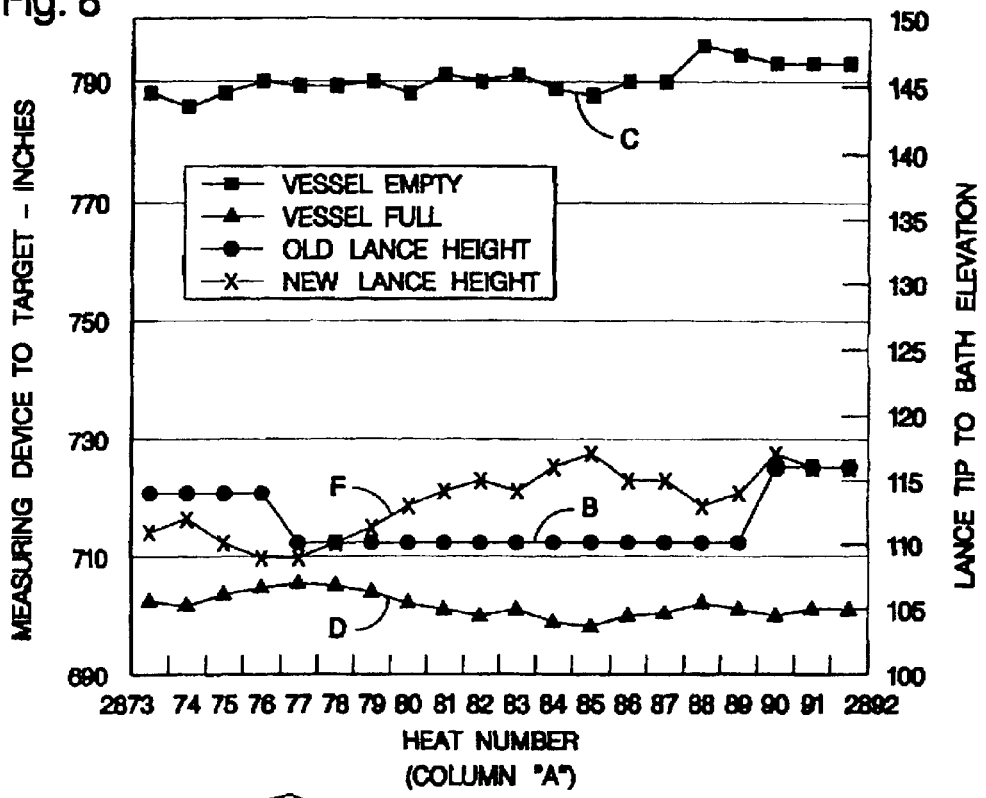
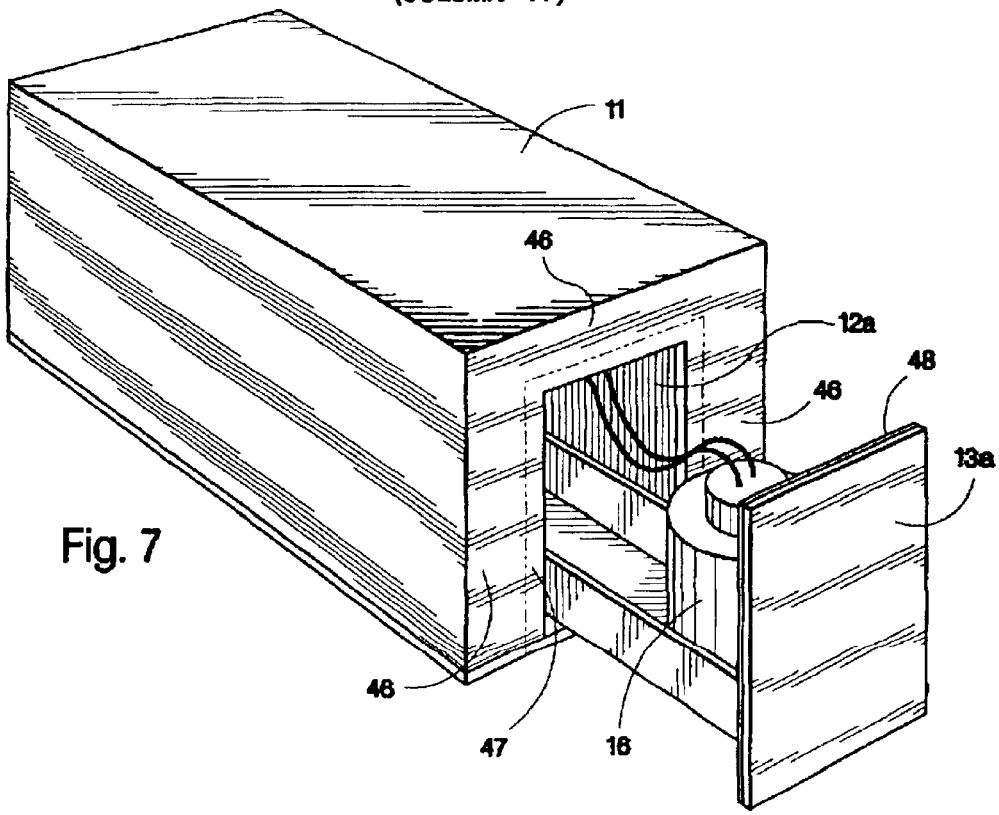
Fig. 7

METHOD FOR MEASURING BATH LEVEL IN A BASIC OXYGEN FURNACE TO DETERMINE LANCE HEIGHT ADJUSTMENT

This is a division of application Ser. No. 09/656,317 filed Sep. 6, 2000 now U.S. Pat. No. 6,440,355 B1, issued Aug. 27, 2002.

BACKGROUND OF THE INVENTION

1. Field of the Invention

This invention is directed to a device for determining proper oxygen lance height adjustment for a basic oxygen furnace (BOF) operation, and in particular, it is directed to laser based measuring apparatus capable of being positioned above the mouth of a BOF vessel so that repeated distance measurements to a target area within the vessel may be taken to provide a collection of measurement readings that are used to determine proper oxygen lance height adjustment for each or any selected heat manufactured during a steelmaking campaign. The laser-based measuring device includes an extendable optical head mounted within a protective air-cooled housing attached to an oxygen lance crane assembly, and a combined laser transmitter/receiver unit that communicates with the optical head from a remote position. The air-cooled housing is positioned above the mouth of a BOF at a location that provides the optical head with access to a line of sight extending down through the oxygen lance crane assembly, through a lance opening provided in the off-gas hood, and into the mouth of the BOF vessel. The laser-based measuring device further includes a spring loaded cylinder that is selectively operated to both remove a protective cover from an opening provided in the air-cooled housing, and extend the optical head outward from a stored position within the housing. The optical head is extended outward through the housing opening and into a line of sight down through the lance crane assembly, through the BOF mouth, and into the vessel interior. The spring loaded cylinder also selectively operated to retract the extended optical head back into its stored position within the housing and replace the protective cover over the housing opening. In its closed position, the protective cover shields the optical head and associated mechanisms from dust and fume generated during the BOF steelmaking process. Additionally, the air-cooled housing may also include a hinged or removable panel for convenience during maintenance and repair.

2. Brief Description of the Related Art

There has been a long felt need within the steelmaking industry to develop a more precise method for determining oxygen lance height adjustment. Correct lance height adjustment is critical to proper mixing at the steel/slag interface in a BOF steelmaking operation. In the past, such lance height adjustments were determined by calculations based on a once a day topographic measurement of the vessel interior. For example, a typical BOF heat cycle generally begins when an empty hot metal charging ladle arrives at the pouring station after the ladle has been used to charge a previous heat. A charge calculation is then made for the next scheduled heat and the ladle is filled with a calculated amount of molten iron. The charge calculation is generally made using a mass-energy balance model. The charge model calculates the weights of hot metal, cold pig iron, steel scrap, and flux materials that are used to produce a specified weight, temperature, and chemical analysis of steel at the end of the oxygen blow. In many BOF shops a predetermined weight of hot metal and scrap is weighed out early based upon the once a day topographical measurement of the vessel interior, and the final weights are obtained by trimming either the hot metal, the scrap, or both after the charge calculation for the heat has been completed. In the past, molten metal bath level was calculated using a once a day topographical or profile measurement of the vessel interior along with the charge model calculations. However, such calculations are inaccurate due to changing vessel shape. For example, after a finished heat is tapped, BOF vessels are rocked back and forth to provide a slag-splash coating that solidifies on the refractory lining to provide a protective coating against refractory erosion. Slag-splash coating is done before the remaining slag is poured from the vessel into a waiting slag car.

Slag splashing practice, in combination with the erosive effects of the hostile steelmaking process on the refractory lining, creates a dynamic, continuously changing interior space within the BOF vessel. As a result, bath level calculations of the past, based on a once-a-day vessel profile measurement, are inaccurate and may result in placing the oxygen lance either too high or too low with respect to the slag/metal interface. If an oxygen lance is positioned low, the velocity of the oxygen causes molten metal and slag to erupt from the vessel creating a hazardous condition. Low lance placement also causes skull to build up on the lance and causes overheating that reduces lance tip life. This condition also lowers the iron oxide content in the slag layer that floats on the surface of the molten metal bath. If a lance is positioned high, it becomes more difficult to lower the carbon level in the molten metal bath. A high lance will also generate higher oxygen levels in the cone portion of the furnace and a higher iron oxide content in the slag, both of which will cause excessive refractory wear.

Vessel measurements are taken only once a day because present state of the art vessel measuring devices and techniques require operators to take the vessel out of service so that the measuring apparatus, for example a laser device, can be moved into a measuring position in front of the BOF vessel. Such operations are time consuming and expensive with respect to productivity. For example, at the Bethlehem Steel Sparrows Point operation, it takes between about 45–50 minutes to produce a heat of steel, and each BOF vessel produces about 20 heats of steel per day. In a best case scenario, it takes operators about 20–30 minutes to take a vessel interior profile measurement. Therefore, from a lost-time viewpoint, such profile measurements are generally spaced apart as far as practical to avoid driving down steel production.

Various laser-based measuring devices are in use for detecting molten metal bath levels. For example, U.S. Pat. Nos. 5,190,717 and 5,090,603, issued to Bayliss, disclose a laser based metal pouring system for applying a molten metal coating to the surface of a steel substrate. The apparatus uses laser probes to measure coating thickness and to maintain a constant bath level in the pot. However, although Bayliss broadly teach using a laser beam to measure the level of a molten metal bath contained within a vessel, the drawing figures show an unprotected laser probe positioned above the molten metal bath. The Bayliss laser probe operates in an antiseptic environment as compared to the dust-laden, hostile environment above the mouth of a BOF converter. Therefore, Bayliss fails to recognize the problems associated with placing an electro/optical device within the hostile environment above a BOF steelmaking vessel, and his disclosure completely fails to provide any teaching or suggestion for overcoming such problems.

Another laser-based measuring device is shown in U.S. Pat. No. 4,899,994 granted to Zhidkov, et al. The 994 patent teaches mounting a γ radiation transmitter and a γ radiation receiver above the mouth of a BOF steelmaking vessel to measure the level of molten metal in the vessel. Such devices are very hazardous from a radiation viewpoint, and would likely not be used in the United States due to their high radiation levels. However, because such γ radiation devices are likely not affected by high dust levels, the disclosure fails to address dust related problems associated with a BOF steelmaking operation. Accordingly, the inventors fail to teach, or even suggest, protecting their sensor from the hostile environment above a BOF vessel.

Therefore, there is a long felt need within the industry to provide a safe, radiation free, measuring device that will allow operators to make repeated vessel measurements in the hostile BOF steelmaking environment to determine critical $O_2$ lance height adjustments with respect to the slag/metal interface without reducing productivity.

SUMMARY OF THE INVENTION

Accordingly, it is therefore a first object of the present invention to provide improved accuracy in oxygen lance height adjustment in a BOF steelmaking operation.

It is another object of the present invention to provide a measuring device capable of measuring distance to a target area within a steelmaking vessel without decreasing steelmaking productivity.

It is still another object of the present invention to provide a measuring device capable of measuring distance to a target area within a steelmaking vessel while the lance crane assembly associated with the steelmaking vessel is in a steelmaking position.

It is another object of this invention to provide a measuring device capable of measuring distance to a target area within a steelmaking vessel before the start of each heat produced during a steelmaking campaign.

It is still another object of the present invention to provide a measuring device capable of being located at a permanent operating position within the hostile environment above the mouth of a BOF steelmaking vessel.

Another object of this invention is to provide an improved method for determining lance height adjustment with respect to a calculated bath surface of a selected heat based upon a continuing series of measurement readings to a target area within a metallurgical vessel.

Other objects and advantages of the present invention will become apparent as a description thereof proceeds. In satisfaction of the foregoing objects and advantages, the present invention provides a measuring device adapted to measure a distance to a target area within a metallurgical refining vessel while an associated lance crane assembly is in its refining position above the metallurgical vessel. The measuring device includes an optical head that is positioned to direct to the target area an energy beam received from an energy source, and to direct to a processor an energy beam reflected from the target area. The optical head is contained within a housing and is attached to a movable mounting that may be selectively extended to expose the optical head to the target area, and selectively retracted to shield the optical head within the housing when measurements are not being taken.

BRIEF DESCRIPTION OF THE DRAWINGS

Reference is now made to the drawings of the invention wherein:

FIG. 7 is an alternate embodiment of the present invention.

FIG. 8 is a graph illustrating the data listed in TABLE A.

DETAILED DESCRIPTION OF THE PREFERRED EMBODIMENT

The present invention advances the art of determining critical oxygen lance height adjustment to properly place a BOF oxygen lance with respect to the slag/metal interface (bath elevation) during an oxygen blow into the BOF steelmaking vessel. A typical BOF heat cycle generally begins when the charging ladle arrives at the hot metal pouring station. A charge calculation, based upon a mass-energy balance model, is made for the scheduled heat, and the charge model calculates the weights of hot metal, cold pig iron, steel scrap, and flux materials required to produce a specified weight, temperature, and chemical analysis of the desired steel product being manufactured in the vessel. In many BOF shops, a predetermined amount of hot metal and scrap may be weighed out early, and final weight adjustments are made by trimming the predetermined materials after the charge for the heat is calculated.

In the past, such charge calculations were used in combination with a once a day laser based topographic measurement of the vessel lining to calculate an estimated bath level for each heat produced throughout the day. Such estimated bath level calculations are inaccurate because continuous increasing or decreasing slag buildup along the vessel lining changes the available steelmaking capacity (vessel volume) from one heat to the next. As a result, once a day laser measurements often provide a false indication of vessel volume, and such misinformation may result in a calculated bath level error and improper adjustment of the oxygen lance height for the $O_2$ blow. Improper lance height adjustment can cause various problems in a BOF steelmaking operation. For example, if the $O_2$ lance is positioned above or within the slag/metal interface, the slag cover floating on the surface is over oxidized, and excess amounts of FeO produced during such over oxidization causes accelerated refractory wear along the upper lining of the vessel. On the other hand, if the $O_2$ lance penetrates too deep into the molten metal bath, too far below the slag/metal interface, poor mixing occurs at the interface and the decarburization rate of the steelmaking process decreases. Reduced decarburization reduces productivity because it slows the reduction of iron into steel, and reduced decarburization drives up steelmaking costs by consuming excess amounts of oxygen and expensive additives. Additionally, a deep penetrating $O_2$ lance tip will cause excessive refractory wear along the vessel bottom lining, thereby decreasing service life of the vessel which also decreases productivity and increases costs.

Figure 1:
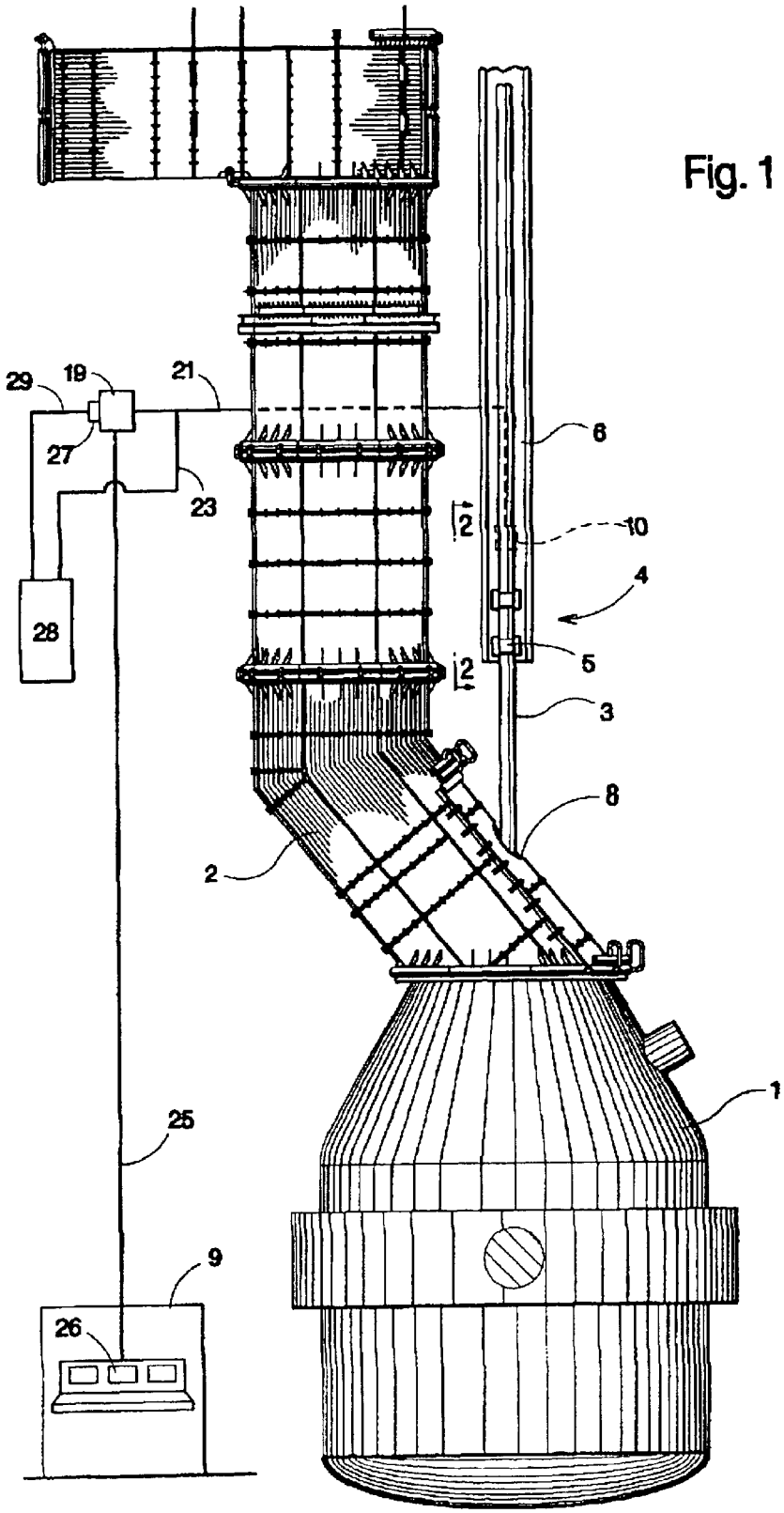
FIG. 1 is an elevation view showing the preferred embodiment of the present measuring device installed above the mouth of a BOF steelmaking vessel.
Figure 2:
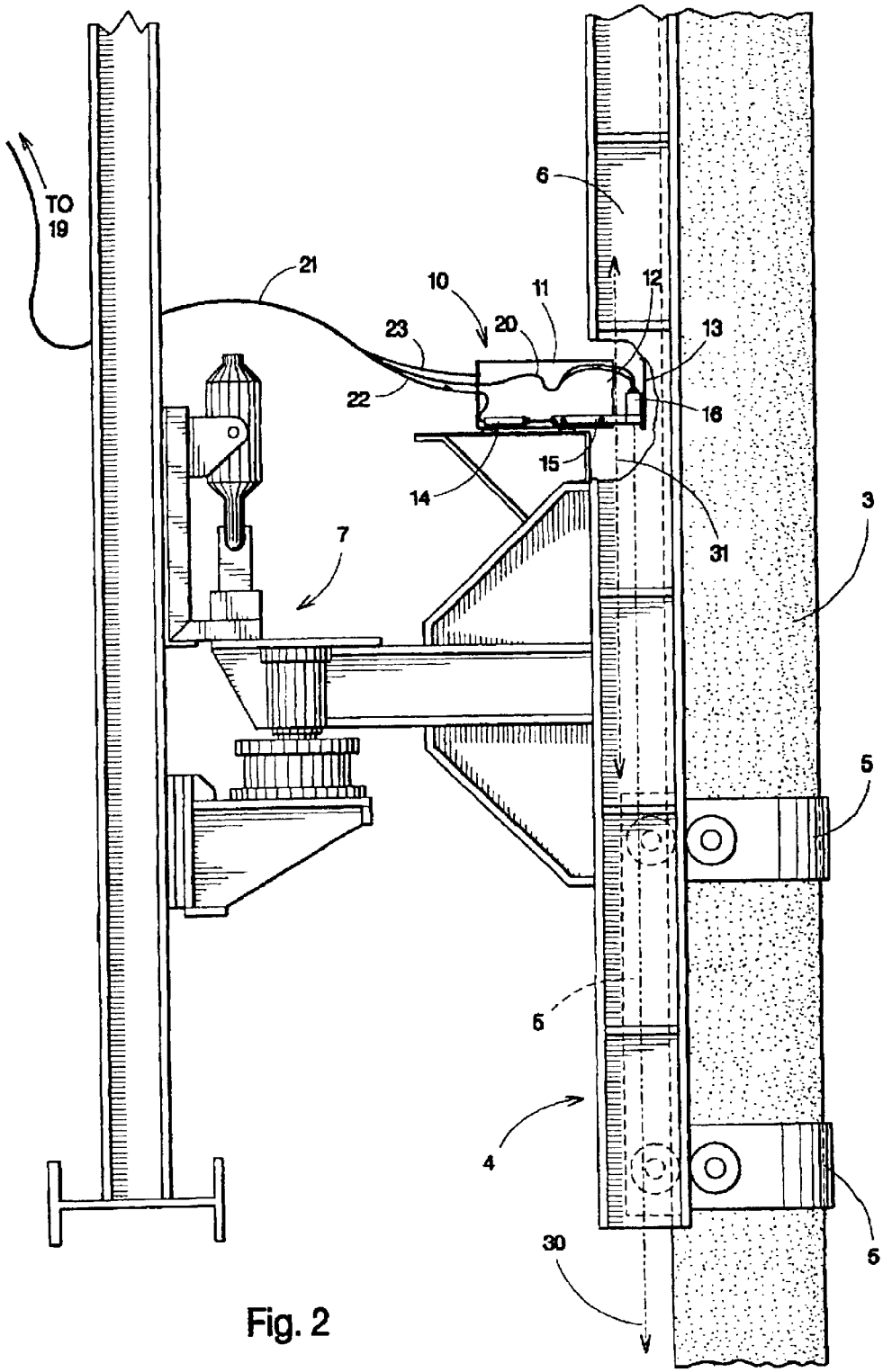
FIG. 2 is an enlarged view of a portion of the measuring device installation shown in FIG. 1.

The present invention overcomes such past problems by providing a laser based measuring device capable of taking slag surface measurements after each heat and vessel bottom lining measurements before each heat produced during a BOF campaign while the lance crane assembly is in its steelmaking position. Referring to FIGS. 1 and 2 of the drawings, a state-of-the-art BOF steelmaking operation comprises a basic oxygen furnace 1, an off-gas hood 2, attached to appropriate environmental apparatus such as a wet scrubber to prevent steelmaking fume and dust from reaching the atmosphere, and an oxygen lance 3 for injecting oxygen below the surface of the molten metal bath contained in the BOF steelmaking vessel 1. The oxygen lance 3 is mounted to a lance crane assembly 4 comprising a carriage 5 that travels either downward along a crane structure 6 to insert the oxygen lance into the steelmaking vessel 1, or travels upward along crane structure 6 to remove the oxygen lance from the steelmaking vessel. A lance opening 8 in the off-gas hood 2 provides lance access to the vessel interior. The vertical traveling carriage 5 also enables operators to adjust the oxygen lance height with respect to the level of the slag/metal interface of the heat being manufactured in the vessel.

In the past, when operators took once a day measurements of the vessel lining, it was necessary for steelmakers to (a) raise carriage 5 to withdraw lance 3 from the vessel; (b) rotate the vessel from the upright steelmaking position to a horizontal position, exposing the vessel interior to the laser apparatus positioned on the operating floor; (c) moving a vessel measuring device (not shown) into a measuring position adjacent the mouth of the horizontal vessel; (d) measure the profile of the vessel interior; (e) move the vessel measuring device away from its measuring position; (f) rotate the vessel back to the upright steelmaking position; (g) lower carriage 5 to insert lance 3 back into the steelmaking vessel; and (h) adjust lance height based upon calculations using the once a day profile measurement of the vessel interior. In a best case scenario, such an 8-step measuring process will take between 20–30 minutes to complete, and therefore, is impractical for taking frequent vessel measurements throughout a BOF steelmaking campaign.

Figure 3:
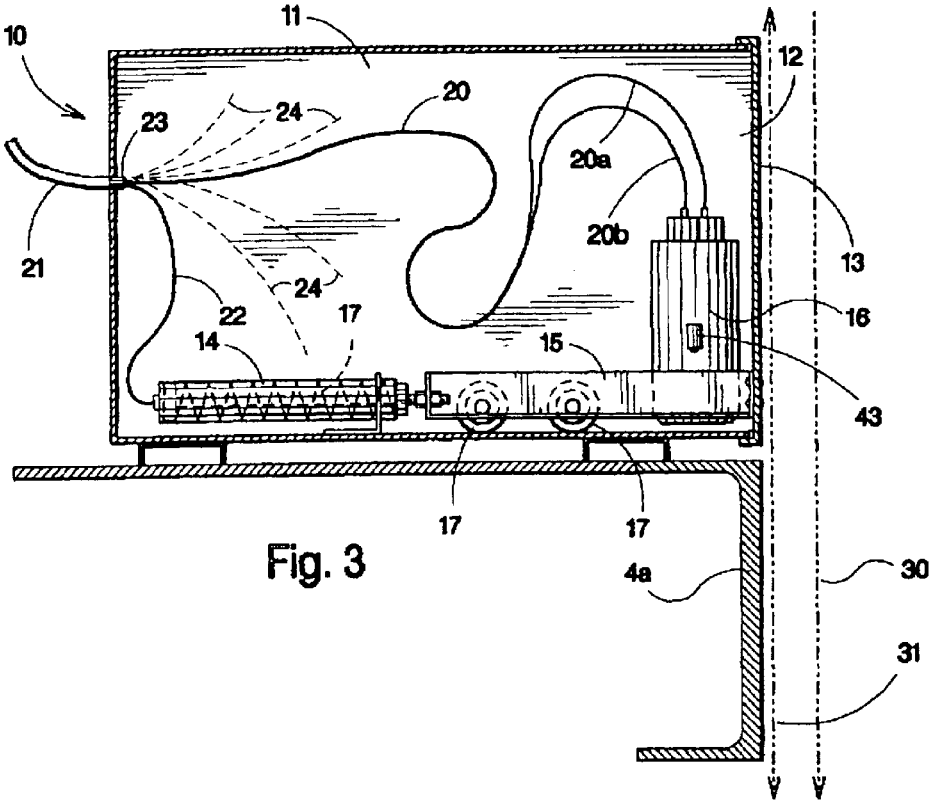
FIG. 3 is a cross-section view taken through the housing of the preferred embodiment of the present measuring device invention.
Figure 4:
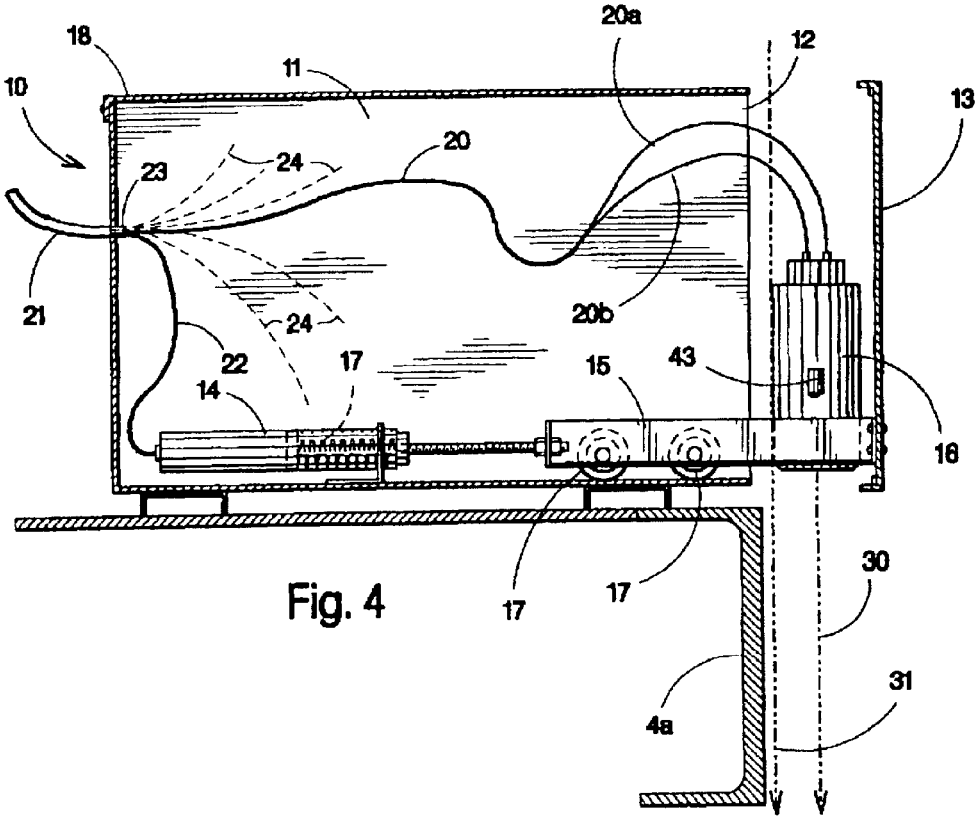
FIG. 4 is a cross-section view similar to FIG. 3 showing the measuring device extended to a measuring position above the mouth of a BOF vessel.

In the preferred embodiment of the present laser based measuring device invention, the measuring device 10 is attached to the BOF structure 4*a* at a location above the mouth of the BOF converter 1. The laser based measuring device 10 includes a housing 11 having an open end 12 along the oxygen lance side of the housing, and a movable cover 13. Cover 13 is adapted to fit over opening 12 and is responsive to a drive means 14 by way of a connecting frame 15 that fastens the drive means to the removable cover. The optical head portion 16 of a laser system is fastened to frame 15 so that when drive means 14 is operated, both the laser head 16 and cover 13 follow frame 15 from a stored position to an extended measuring position that aligns the optical head in a line of sight 30 down through the crane structure 6, through lance opening 8 (FIG. 1), and into the steelmaking vessel 1. Additionally, as shown in FIGS. 3–4, frame 15 is supported on wheels 17 that maintain frame 15, laser head 16, and cover 13 in a horizontal plane when drive means 14 is operated. An aiming laser 43 may be provided to sight and align the laser measuring device 10 to the selected target area(s) during initial installation of the device or when the device is moved for routine maintenance and/or repair.

Referring to FIG. 7, housing 11 may include one or more baffles or panels 46 that are positioned to provide a reduced the size of the opening 12*a* that more approximates the size and shape of the laser head 16 extending or retracting therethrough. The extendable door portion 13*a* (moveable cover) is sized to overlap opening 12*a* as shown by the phantom lines 47 and a seal 48 to prevent steelmaking fume and dust from entering the inside space of housing 11 when door 13*a* is in a retracted closed position against the baffles 46. Additionally, the smaller size opening 12*a* provided by baffles 46 makes it more difficult for dust to enter housing 11 when the laser head 16 is extended to the measuring position shown in FIG. 7.

Referring again to FIGS. 3–4, the preferred drive means 14 is an air cylinder and includes a spring mechanism 17 biased toward the retracted position to maintain cover 13 in a closed position over opening 12 when the laser-based measuring device is not in use. It should be understood, however, that the drive means is not limited to a pneumatic cylinder and that any suitable drive means may be used to extend laser head 16 to the line of sight measuring position 30 without departing from the scope of this invention. For example, the drive means may comprise a hydraulic cylinder, a rack and pinion arrangement, or any other electromechanical device known in the art to achieve the same results. As shown in FIG. 4, housing 11 may include a removable service panel 18 that provides access to the housing interior space for servicing the optical head 16 and its associated mechanism.

Referring again to FIGS. 1–4, the preferred laser based measuring device 10 includes laser electronics 19 located within a friendlier environment remote from the BOF vessel. The laser electronics communicate with the optical head 16 through a twin fiber optic cable 20, and includes a laser source to selectively generate an energy beam transmitted along a first fiber optic cable 20*a* to optical head 16, and a photodetector, or the like, for generating an electrical output signal indicative of distance based upon reflected energy that is received from optical head 16 along a second fiber optic cable 20*b*. The output signal indicative of distance is sent to a computer 26 located in pulpit 9 where a resident program processes the signal for use in calculations that determine oxygen lance height adjustment for the current heat.

The twin fiber optic cable 20 is enclosed within a protective braided cable 21 that shields the fiber optic cables 20*a* and 20*b* from the hostile steelmaking environment. Cable 21 also houses an air line 22 having one end attached to the pneumatic drive means 14 and its opposite end attached to a pressurized air supply 28 controlled by a solenoid valve 27. A second air supply line 23 is housed within braided cable 21 to provide an air purge 24 injected into the interior space of housing 11. The air purge is injected into housing 10 at a pressure of about 90 psig and at a temperature sufficient to maintain the interior space below about 140° F. In some instances, the air supply line 23 may be attached to a cooled pressurized air supply 28 to inject a cooling air purge 24 into the interior space of housing 11. The forced air purge also creates a positive pressure within housing 11 when the protective cover is closed. The positive pressure prevents steelmaking fume and dust from entering the housing and contaminating the optical head and drive mechanism during the steelmaking operation. Additionally, the air purge also provides an outward airflow, or an air wipe, through opening 12 when cover 13 is opened to extend the optical head into the line of sight 30. The air wipe flow shields the open interior of housing 11 from dust and fume during measuring operations.

As more clearly shown in FIGS. 1 and 2, because the laser electronics 19 and the optical head 16 are spaced apart, the improved laser based measuring device provides a compact measuring tool capable of being inserted into small spaces above a metallurgical vessel. The smaller size device, with its extendable optical head 16, makes it possible to install the laser based measuring device 10 adjacent the carriage travel path 31 so that only the optical head portion 16 needs to be extended into the narrow line of sight 30 that is available down through the lance crane structure 6 into the mouth of the BOF vessel 1. This arrangement enables operators to make vessel interior measurements without a need to rotate the vessel from its steelmaking position as described in the above prior 8-step vessel measuring process. Therefore, the improved laser-based measuring device provides means for measuring selected target areas within a metallurgical vessel before or after every or any selected heat produced during a manufacturing campaign without affecting productivity.

Figure 6:
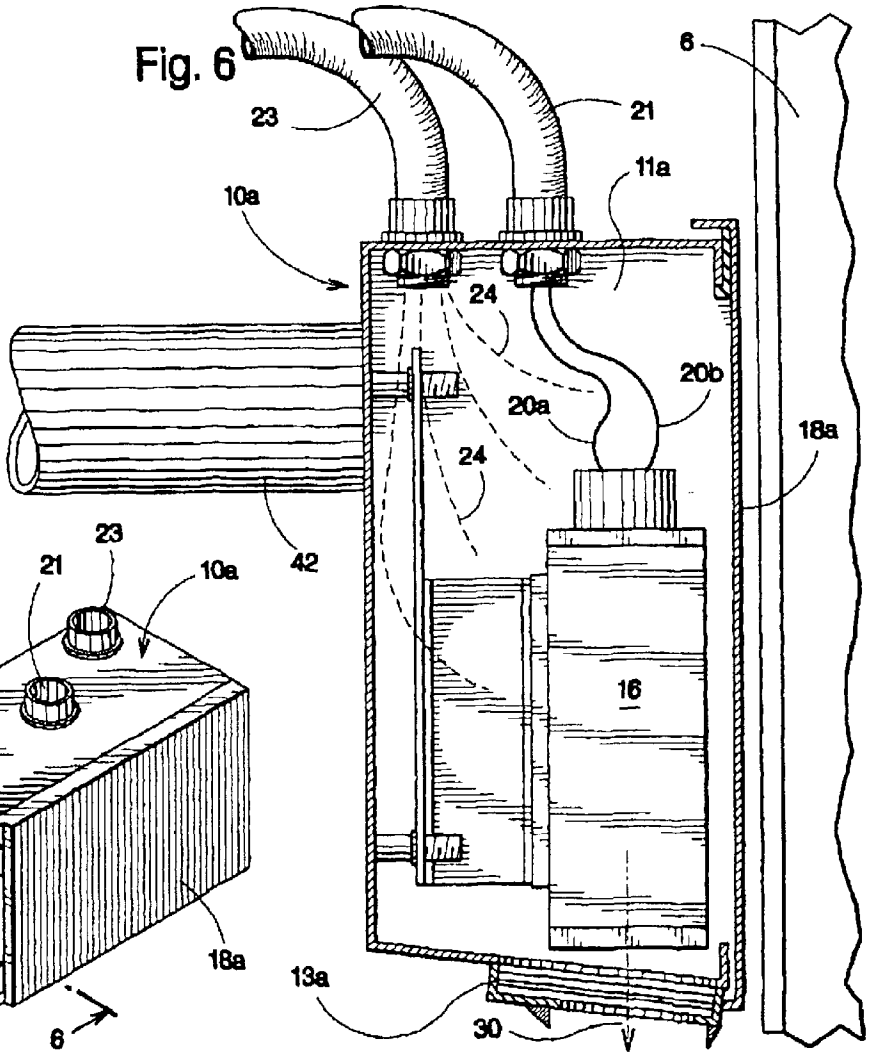
FIG. 6 is a cross-section view taken along the lines 6—6 of FIG. 5.
Figure 5:
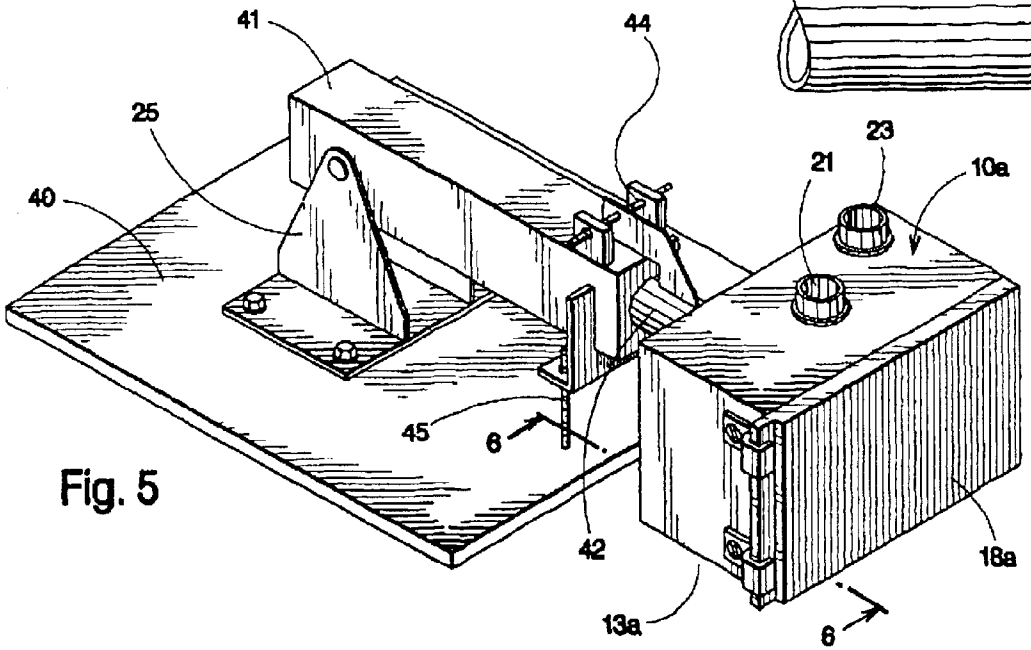
FIG. 5 is an isometric view of an alternate measuring device embodiment.

In instances where the equipment arrangement provides a wider clearances at the line of sight into the metallurgical vessel, an alternate measuring device without an extendable drive means, may be used to take measurements to target areas within the metallurgical vessel. One example of such an alternate measurement device 10*a* is shown in FIGS. 5 and 6. The alternate embodiment includes a stationary optical head 16 fastened within a housing 11*a*. The housing includes a solenoid (not shown) actuated sliding panel or shutter 13*a* that is operated to an open position to expose the optical head 16 to the line of sight 30 extending to the target area within the metallurgical vessel, and is operated to a closed position to shield the optical head within housing 11*a* when measurements are not being taken, for example during metallurgical refining operations. The optical head receives energy beams transmitted along fiber optic cable 20*a*, and transmits reflected energy beams along the second fiber optic cable 20*b* of twin cable housed within the braided cable 21 as heretofore described above. Housing 11*a* also includes a removable panel 18*a* similar to the preferred embodiment to provide access to the housing interior.

Housing 11*a* is attached to the vessel structure 40 via a mounting arm 41 having a first end attached to a pivot mount 25 and a second end 42 attached to housing 11*a*. An air line 23, attached to the pressurized air source 28 (FIG. 1), provides an air purge flow 24 into the interior space of the housing 11*a*. Alternatively, as described in the preferred embodiment, the air purge may be conveyed along the braided cable 21 to cool both the fiber optic cables 20*a* and 20*b* and the interior space of housing 11*a*.

A horizontal adjustment means 44, and a vertical adjustment means 45 is provided to enable technicians to align optical head 16 along the line of sight to the target area within the vessel.

The following description is directed to a method for determining lance height adjustment using the preferred laser-based measuring device 10. It should be understood, however, that the alternate embodiment 10*a*, or other measuring device, may be operated in a similar manner by one skilled in the art without departing from the scope of this invention.

Referring to FIG. 1, the preferred laser-based measuring device 10 is operated by a controller normally located in pulpit 9 on the charge floor of the BOF shop. The controller may be either a person who manually operates the laser-based measuring device, or the controller may be a computer 26 and resident program that automatically sends output signals along cable 25 to operate the laser based measuring device. The present disclosure describes operating the laser based measuring device 10 with a computerized controller 26. However, and it should be understood that measuring device 10 may just as well be manually operated by a person without departing from the scope of this invention.

At the start of a steelmaking cycle, controller 26 sends an output signal along a first line within cable 25 to activate solenoid valve 27 that controls the flow of air along feed line 29 extending from the pressurized air supply 28. In response to the output signal, solenoid valve 27 is opened to release a flow of pressurized air along line 22 housed within braided cable 21 (FIGS. 3–4) and the pressurized air exerts a force against the piston within drive means 14. The applied force compresses spring 17 and moves frame 15 outward from housing 11 to align laser head 16 along the line of sight 30 to the target area at the vessel bottom lining. As shown in FIG. 4, when frame 15 is extended outward from housing 11, cover 13 follows the frame away from its closed position over end 12 of the housing and thereby provides an opening that enables the laser optical head 16 to be extended to the line of sight 30 position that communicates with the interior of the metallurgical or steelmaking vessel.

After laser head 16 is extended into the line of sight 30, the laser or energy source within the laser electronics box 19 is activated by an output signal from controller 26. In response to the signal, an energy beam is generated and transmitted along the first fiber optic cable 20*a* to the optics in laser head 16, and the laser optics redirect the energy beam along the line of sight 30 to the target area within the vessel. The energy beam impacts upon the target and the reflected energy beam is received by the laser optics in head 16 and is further transmitted along the second fiber optic cable 20*b* to a photodetector housed within the laser electronics box 19. The photodetector, or other device capable of achieving the same results, converts the reflected energy beam into an amplified electrical signal indicative of distance to the target area, and the amplified signal is transmitted along a second line within cable 25 to controller 26. The resident program processes the incoming amplified electrical signal to provide an initial measurement or base line reading to the vessel bottom lining, and the base line reading is stored for later use in determining an increasing or decreasing slag buildup trend on the vessel lining. The base line reading may be displayed on a monitor for use by operating personnel. After the initial base line reading is taken, and after the controller sends a signal to deactivate the laser source, solenoid valve 27 receives an output signal from controller 26 to close the pressurized air supply valve. In response, the compressed spring 17 forces frame 15 and the attached laser head 16 and cover 13 back to their retracted stored and closed positions respectively to protect the laser optics and related mechanisms from the fume and dust generated during the steelmaking process (FIG. 3).

The steelmaking vessel 1 is charged with steel scrap and molten iron delivered from the blast furnace. When the charge is completed, the oxygen lance 3 is lowered through hood opening 8 to a lance height related to a calculated bath level for the heat based upon the charge calculations and the once a day profile reading described above. After the lance is adjusted to its proper height with respect to the calculated bath level or elevation, oxygen is blown into the molten metal bath to reduce the molten iron into steel.

At the end of the heat, after the oxygen blow is stopped, it is a normal practice for steelmakers to take a sample of the molten steel for analysis purposes. During this time, while the operators are waiting for their analysis results, and while the molten metal bath is relatively quiet or still, controller 26 sends an output signal to activate the solenoid valve 27 and extend laser head 16 outward to its line of sight measuring position 30. At least one distance reading is taken to a target area on the surface of the molten slag cover floating on the metal bath by generating an energy beam as heretofore described. The energy beam is reflected back from the slag cover and is transmitted to the photodetector as herein described, and the resulting amplified electrical signal, indicative of a distance to the surface of the slag cover, is received by controller 26 where it is further processed by the resident program to provide a slag level reading that is stored with a continuing history of such readings used to calculate bath level elevations for proper oxygen lance height adjustments. The slag level reading may also be displayed on the monitor for use by operating personnel.

After the slag level reading is taken, the laser head 16 is retracted to its stored position within housing 11 and cover 13 is closed to protect the laser measuring apparatus during the tapping operation. If the analysis results are positive, the steelmaking vessel is rotated to the tap side and the molten steel is drained from the BOF vessel. When slag begins to appear in the tap stream, the vessel is rotated to the upright position and the slag splash process coats the refractory lining with molten slag. Any molten slag remaining after splash coating is poured from the vessel into a waiting slag car.

When the steelmaking vessel 1 is completely drained of molten slag, after the slag pour off and before the next charge, the empty hot vessel is rotated to its upright steelmaking position and controller 26 once again sends a signal that extends the optical head 16 to its measuring position along the line of sight 30. The laser source within box 19 is activated by the controller and generates an energy beam that is transmitted along fiber optic cable 20*a* to laser head 16. The laser head redirects the energy beam along the line of site 30 to the target area at the vessel bottom lining to take a slag build-up reading. The new slag build-up reading is stored with a continuing history of such slag build-up readings, and the resident program compares the base line reading with both the slag build-up history and the slag level history to determine if there is a trend toward an increase or decrease of slag build-up on the vessel lining (slag build-up trend). The resident program then calculates the slag/metal interface (bath level elevation) to determine proper lance height adjustment for the next heat based upon the charge calculation figures for the next heat, the slag build-up trend, and a calculated slag volume estimate for the heat. In response to the calculated bath level elevation, controller 26 sends a signal that regulates the carriage drive mechanism and moves carriage 5 along the crane structure 6 to a location that properly adjusts the oxygen lance tip height with respect to the calculated slag/metal interface for the next scheduled heat. Alternatively, the calculated slag/metal interface and/or the next lance tip position is displayed on the monitor so operators can manually adjust the lance tip elevation with respect to the slag/metal interface.

In the preferred method for determining lance tip height adjustment, the laser-to-target measurements are repeated for each heat produced during a steelmaking campaign, and the continuing history of slag level measurements and slag build-up measurements are compared with the base line and a once a day vessel profile reading to determine the slag build-up trend. However, it should be understood that operators may choose to skip target area measurements on certain selected scheduled heats without departing from the scope of this invention. For example, operators may choose to take laser-to-target measurements every second, or every third heat, etc., without departing from the scope of this invention. The improved measurement device 10 enables operators to take a multiplicity of distances readings throughout the day, or throughout an entire steelmaking campaign because the improved device eliminates any need to remove the vessel from operation when laser-to-target measurements are being taken.

Referring to the graph shown in FIG. 8, plotted from the data listed in Table A below, the continuing history of measurement data that was heretofore not available, provides more accurate lance tip height adjustments than such lance height adjustments of the past that were based on a once a day vessel profile measurement. For example, referring to the Table A, column "B" labeled "Lance Height Setting", and to the corresponding plot "B" shown in FIG. 8, past lance tip height adjustments were made in response to a lance height calculation that was based upon a once-a-day profile measurement, a charge calculation, and a slag thickness calculation. The lance position was adjusted to agree with the calculation, and it remained at the calculated elevation until operators were able to take a new profile measurement (about 24-hours). For instance, column "B", and corresponding plot "B" in FIG. 8, show an adjusted lance tip height of 114 inches above a theoretical or calculated bath elevation (i.e. above "0") for the last heats 2873 through 2876 of an earlier steelmaking cycle. This 114 inch lance tip elevation is based upon an earlier vessel profile reading that was used to calculate the theoretical bath elevation from which the lance height was adjusted. The recorded data shows that a new vessel profile measurement (Profile Reading #1) was taken between Vessel No. 2 heats 2876 and 2877. Based upon this new profile reading a new theoretical bath elevation was calculated and the lance tip height was adjusted to 110 inches accordingly. The lance tip remained at 110 inches until the next profile measurement (Profile Reading #2) was taken between heats 2889 and 2890. Based upon the #2 profile reading, a new theoretical bath level was calculated and the lance tip height was adjusted to 116 inches above zero for the next steelmaking cycle, (about 24-hours).

Referring to Table A, columns "A–F" and the corresponding plotted data in FIG. 8, the apparatus and method of the present invention was used to determine proper lance tip height adjustment for each heat produced in the steelmaking cycle extending from heat number 2877 through heat number 2889. The distance measurements taken from the measuring device 10 to the selected target within the steelmaking vessel 1 (FIG. 1) are shown in columns "C" and "D". Column "C" lists the distance readings from the measuring device to a target area at the vessel bottom lining, and the recorded information enables operators to determine an increasing or decreasing slag buildup trend on the vessel lining. Column "D" lists the distance from the measuring device to a target area on the surface of the slag blanket floating on the molten metal bath, and the recorded information is used, in combination with a calculated slag blanket thickness, to determine a theoretical bath elevator or "0" from which the lance tip adjustment is measured. Column "E" shows the difference in calculated theoretical bath elevations for successive heats, and column "F" lists the calculated lance tip height based upon the differences shown in column "E".

TABLE A

| Date Year 2000 | "A" Heat No. | "B" Lance Height Setting | "C" Empty Vessel Reading | "D" Full Vessel Reading | "E" Bath Height Difference | "F" New Lance Height Setting |
|---|---|---|---|---|---|---|
| 6/18 | 2873 | 114 | 788 | 703 | | 111 |
| | 2874 | 114 | 786 | 702 | 1 | 112 |
| | 2875 | 114 | 788 | 704 | −2 | 110 |
| | 2876 | 114 | 790 | 705 | −1 | 109 |

TABLE A-continued

| Date Year 2000 | "A" Heat No. | "B" Lance Height Setting | "C" Empty Vessel Reading | "D" Full Vessel Reading | "E" Bath Height Difference | "F" New Lance Height Setting |
|---|---|---|---|---|---|---|
| | | | Profile Reading #1 | | | |
| | 2877 | 110 | 789 | 706 | −1 | 109 |
| | 2878 | 110 | 789 | 705 | 1 | 110 |
| | 2879 | 110 | 790 | 704 | 1 | 111 |
| | 2880 | 110 | 788 | 702 | 2 | 113 |
| | 2881 | 110 | 791 | 701 | 1 | 114 |
| | 2882 | 110 | 790 | 700 | 1 | 115 |
| 6/19 | 2883 | 110 | 791 | 701 | −1 | 114 |
| | 2884 | 110 | 789 | 699 | 2 | 116 |
| | 2885 | 110 | 788 | 698 | 1 | 117 |
| | 2886 | 110 | 790 | 700 | −2 | 115 |
| | 2887 | 110 | 790 | 700 | 0 | 115 |
| | 2888 | 110 | 796 | 702 | −2 | 113 |
| | 2889 | 110 | 795 | 701 | 1 | 114 |
| | | | Profile Reading #2 | | | |
| | 2890 | 116 | 793 | 700 | 1 | 117 |
| | 2891 | 116 | 793 | 701 | −1 | 116 |
| | 2892 | 116 | 793 | 701 | 0 | 116 |

If we compare the calculated lance tip height adjustments listed in column "F" with the once-a-day 110 inch adjustment determined by profile reading #1, we see that the new measuring device and method greatly improves the accuracy of such lance height adjustments. For example, in heat number 2885, the 110 inch lance height adjustment has an error of more than 6% when compared to the more accurate corresponding lance height adjustment shown in column "F".

Additionally, when it is established that there is consistent accuracy between the last lance height adjustment in a given steelmaking cycle, for example heat 2876, and the first lance height adjustment in the next steelmaking cycle, where the adjustment is based upon a profile reading, for example Profile Reading #1, operators may elect to extend the cycle time between vessel profile measurements. Such extended cycle times will dramatically improve steelmaking productivity. To illustrate, if the cycle between successive profile measurements were extended to say 48-steelmaking periods, a vessel would produce one extra heat of steel every two days and thereby increase productivity by about 7,800 tons of steel per year.

While this invention has been described as having a preferred design and method of operation, it is understood that it is capable of further modifications, uses, and/or adaptations following in general the principle of the invention and including such departures from the present disclosure as come within known or customary practice in the art to which the invention pertains, and as may be applied to the essential features set forth herein, and fall within the scope of the invention limited by the appended claims. For example, while the preferred embodiment shows and describes using a laser as an energy source, any energy source capable of generating a signal indicative of distance to the target area may be used to determine the slag/metal interface and/or lance height adjustment without departing from the scope of this invention. Such exemplary energy sources may include any of the light, radar, or microwave wavelengths.

I claim:

1. A method for adjusting the height of a lance with respect to a bath surface of any selected heat manufactured in a metallurgical vessel during a continuing series of heats, comprising:

a) measuring and storing a profile reading of the metallurgical vessel interior;

b) positioning a measuring device within a line of sight to at least one target within said metallurgical vessel;

c) determining and storing a first distance measurement between said measuring device and said at least one target;

d) charging said metallurgical vessel with an amount of raw materials calculated from said stored profile reading of the metallurgical vessel interior;

e) determining a bath surface elevation for said heat, said bath surface elevation calculated from said profile reading and said amount of raw materials charged;

f) adjusting the lance height in response to said calculated bath surface elevation;

g) refining and tapping said heat;

h) determining and storing a successive distance measurement between said measuring device and said at least one target;

i) determining a slag buildup on said vessel interior, said slag buildup calculated from said first distance measurement and said successive distance measurement to said at least one target;

j) determining a bath surface elevation for said heat calculated from said profile reading, an amount of raw materials charged, and said slag buildup calculation; and k) repeating steps f) through j) for any selected heat in said continuing series of heats.

2. The method recited in claim 1 wherein steps f) through j) are repeated for each heat in the continuing series of heats.

3. The method recited in claim 1 wherein step a) measuring and storing a profile reading of the metallurgical vessel interior is selectively repeated.

4. The method recited in claim 1 wherein the step a) measuring and storing a profile reading of the metallurgical vessel interior is repeated once a day.

5. The method recited in claim 1 wherein said metallurgical vessel is a steelmaking vessel.

6. The method recited in claim 5 wherein said steelmaking vessel is a basic oxygen furnace.

7. The method recited in claim 5 wherein said steelmaking vessel is an electric furnace.

8. A method for adjusting the lance height with respect to a bath surface of any selected heat manufactured in a BOF during a steelmaking campaign, comprising:

a) measuring and storing a profile reading of the BOF interior;

b) positioning a measuring device within a line of sight to at least one target within said BOF rotated to a steelmaking position;

c) determining and storing a first distance measurement between said measuring device and at least one target on a refractory lining in the BOF;

d) charging said BOF with an amount of steelmaking materials calculated from said stored profile reading of the BOF interior;

e) determining a bath surface elevation for said heat calculated from said profile reading and said amount of charged steelmaking materials;

f) adjusting the lance height in response to said calculated bath surface elevation;

g) refining said heat h) determining and storing a distance measurement between said measuring device and the surface of a slag cover floating on said bath;

i) tapping said heat;

j) determining and storing a successive distance measurement between said measuring device and said at least one target on said refractory lining;

k) determining a slag buildup on said refractory lining, said slag buildup calculated from said first refractory lining distance measurement, said successive refractory lining distance measurement;

l) determining a bath surface elevation for said heat calculated from said profile reading, said amount of charged steelmaking materials, and said slag buildup calculation;

m) determining a slag cover thickness calculated from said distance measurement to the slag cover surface, at least one stored distance measurement to said slag cover surface, and a projected slag volume for said BOF;

n) adjusting the lance height in response to said calculated bath surface elevation and said calculated slag cover thickness;

o) repeating steps g) through n) for any selected heat in said continuing series of heats.

9. The method recited in claim 8 wherein steps g) through n) are repeated for each heat in the steelmaking campaign.

10. The method recited in claim 8 wherein step a) measuring and storing a profile reading of the BOF interior is selectively repeated throughout said steelmaking campaign.

11. The method recited in claim 8 wherein step a) measuring and storing a profile reading of the metallurgical vessel interior, is is repeated once a day.

12. In a BOF vessel rotated to a steelmaking position, a method for adjusting the lance height with respect to the surface of a bath contained in the BOF vessel, the improvement comprising:

a) positioning a measuring device within a line of sight to at least one target on a refractory lining within the BOF;

b) taking a real time distance measurement from said measuring device to said at least one target;

c)

d) determining a slag buildup on said refractory lining calculated from said real time distance measurement and at least one stored distance measurement to said at least one target;

e) determining a bath surface elevation calculated from a known BOF vessel capacity, an amount of charged steelmaking materials, and said calculated slag buildup; and f) adjusting lance in response to said calculated bath surface elevation.

13. The method recited in claim 12 comprising the additional steps:

a) taking a real time distance measurement from said measuring device to the surface of a slag cover floating on said bath;

b) determining a slag cover thickness calculated from said real time distance measurement to said slag cover surface, at least one stored distance measurement to said slag cover surface, and a projected slag volume calculated for said BOF;

c) adjusting the lance height in response to said calculated bath surface elevation and said calculated slag cover thickness.

14. The method recited in claim 12 including the further step of withdrawing said measuring device from said line of sight position to a stored position after the lance height is adjusted.

15. The method recited in claim 1 wherein a stored history of successive distance measurements between said measuring device and said at least one target on said refractory surface is used to calculate the slag buildup in step j).

16. The method recited in claim 1 including the further step of withdrawing said measuring device from said a line of sight position to a shielded position before said heat is refined.

17. The method recited in claim 8 wherein a stored history of successive refractory surface distance measurements is used to calculate slag buildup in step k).

18. The method recited in claim 8 wherein a stored history of said distance measurements to said slag cover surface is used to calculate slag cover thickness in step m).

19. The method recited in claim 8 including the further step of withdrawing said measuring device from said a line of sight position to a stored position before said heat is refined.

* * * * *